US005749296A

United States Patent [19]

Haupenthal

[11] Patent Number: 5,749,296

[45] Date of Patent: May 12, 1998

[54] SHEET TRANSFER DEVICE OF A SHEET-FED ROTARY PRINTING PRESS

[75] Inventor: Rudi Haupenthal, Epfenbach, Germany

[73] Assignee: Heidelberger Druckmaschinen Aktiengesellschaft, Heidelberg, Germany

[21] Appl. No.: 821,685

[22] Filed: Mar. 20, 1997

[30] Foreign Application Priority Data

Mar. 21, 1996 [DE] Germany ..... 196 11 124.2

[51] Int. Cl.[6] ..... B65H 9/06

[52] U.S. Cl. ..... 101/410; 101/203; 101/411

[58] Field of Search ..... 101/230, 232, 101/409, 410, 411, 246, 183; 271/204, 277

[56] References Cited

U.S. PATENT DOCUMENTS

| | | | |
|---|---|---|---|
| 3,125,022 | 3/1964 | Reinartz et al. . | |
| 3,417,696 | 12/1968 | Koch et al. . | |
| 3,682,472 | 8/1972 | Barthel | 101/409 |
| 4,466,350 | 8/1984 | Schilling et al. . | |
| 4,664,032 | 5/1987 | Abendruth et al. | 101/411 |
| 4,858,910 | 8/1989 | Rebel et al. | 271/277 |
| 5,461,977 | 10/1995 | Germann | 101/410 |
| 5,596,929 | 1/1997 | Fricke et al. | 101/410 |

FOREIGN PATENT DOCUMENTS

| | | |
|---|---|---|
| 0175695 | 4/1965 | Germany . |
| 1259904 | 2/1968 | Germany . |
| 3112964 | 10/1982 | Germany . |

*Primary Examiner*—Eugene H. Eickholt
*Attorney, Agent, or Firm*—Nils H. Ljungman and Associates

[57] ABSTRACT

A sheet transfer device for a sheet-fed rotary printing press includes a registration correction device. The registration correction device deforms the leading edge of the sheet using a deformable gripper bridge system. The gripper bridge system includes a gripper bridge which extends continuously over the width of the sheet transport path. The gripper bridge is supported at each of its two ends by a pivotable support to allow the gripper bridge to assume a deformed shape similar to that of a simply-supported beam.

20 Claims, 8 Drawing Sheets

SHEET TRANSFER DEVICE OF A SHEET-FED ROTARY PRINTING PRESS

BACKGROUND OF THE INVENTION

1. Field of the Invention

The present invention relates generally to a sheet transfer device, in particular a feed cylinder, of a rotary printing press. The sheet transfer device can include a device for correcting registration by deforming the leading edge of the sheet as a result of the bending of a gripper bridge system.

2. Background Information

A known sheet transfer device is disclosed in German Unexamined Patent Application 31 12 964, corresponding to U.S. Pat. No. 4,466,350. In sheet-fed rotary printing presses, the sheet can undergo a slight change in size during printing. In a multi-color impression, for example, that can result in impressions which are slightly too wide or slightly too narrow. The degree of the dimensional change is determined by a number of factors, as for example, the moisture content, the quality and the flatness of the paper, as well as the size of the sheet to be printed. The wetting of the paper which occurs in offset printing presses also contributes to this phenomenon.

To correct the problem, the above referenced Unexamined German Patent Application teaches that the correct registration of the printed image can be brought about by deforming the front edge of the sheet in or opposite to the direction of travel of the sheet. The known sheet transfer device has a bending device which, as a function of the position of the sheet transfer device, elastically bends a gripper bridge system. As a result of the bending of the gripper bridge system, the corresponding grippers take a sheet which has been picked up from the landing or layout table and deform it in the vicinity of the front edge of the sheet so that a register correction is accomplished.

In this manner, a paper compensator is formed which bends the forward edge of the sheet held by the grippers in the direction opposite to the direction of circulation, for example, as a result of which bending the rear edge of the sheet is stretched taut. The sheet is thereby no longer deformed in the printing gap of the sheet-fed rotary printing press, or it is deformed so little that there are no unacceptable registration discrepancies. The known sheet transfer device has been found to work successfully, but an improvement of the correction measures is still desirable.

OBJECT OF THE INVENTION

It is therefore an object of the present invention to realize a sheet transfer device which has an improved ability for correcting the registration of the printed image.

SUMMARY OF THE INVENTION

The present invention teaches that this object can be accomplished if the gripper bridge system includes a gripper bridge. The gripper bridge can preferably extend continuously all the way across the width of the sheet transport path. The gripper bridge can be mounted in its two terminal areas each by means of a pivot point or rotary bearing, and/or an area where the material is thinner, to preferably form a bending line approximately in the manner of a freely resting beam. For the deformation of the front gripper of a sheet which is being held by grippers of the gripper bridge system, the gripper bridge system can be bent by means of the bending device. As a result of the mounting of the gripper bridge in accordance with the invention, a more or less ideal bending line can be achieved. While in known similar devices, firmly-clamped terminal areas of the grab bridge or gripper bridge can mean that the bending line can end in the axial direction in the area in which the feed cylinder can be fastened, the realization of pivot points and/or areas where the material is thinner can create a more or less elastic fastening and/or a fastening in which the angle at which the force is introduced can be modified, which can result in a bending line which is similar to a freely resting beam.

The term "freely resting beam" as used in this description preferably means that—as will be known to a technician skilled in the art on the basis of strength theory—there is a load case in which the ends of a beam are resting, preferably in a linear manner, on bearing edges, whereby at least one of the bearings of the two terminal areas can execute an axial movement, i.e. in the longitudinal direction of the beam. In the terminal areas of the gripper bridge, this situation can result in a curve of the bending line which does not run—as it could with a fixed beam—exclusively axially, but can enclose an angle with the axial direction. As a result of the present invention, there can be an improvement of the bending line which can make possible an essentially optimum registration correction.

In other words, the term "freely resting beam" as used in this description can also refer to a simply-supported beam or a beam simply-supported on the ends of the beam. A simply-supported beam can have a relatively substantial angular deformation at the supports. In contrast, a fixedly-supported beam, or a beam having fixed supports on both ends of the beam, can have no substantial angular deformation or pivoting at the supports (because of the forces and/or moments generated at the fixed supports to substantially resist or prevent such angular deformation or pivoting).

Depending on the embodiment of the present invention, the bending line can vary somewhat from the ideal of a freely resting beam, but the positive characteristics of the present invention are still achieved.

The present invention can also have the advantage that only a relatively small amount of force from the bending direction must be applied to achieve the paper compensation, because the pivot points claimed by the invention and/or the thinner material zones can make possible a preferably slight elastic deformability of the gripper bridge system.

In an additional embodiment, the present invention teaches that the gripper bridge can be mounted on the feed cylinder by means of the pivot points and/or the thinner material zones.

It can also be advantageous if a continuous gripper shaft is preferably mounted on the gripper bridge. During the deformation of the gripper bridge, the gripper shaft can also become deformed, whereby the shaft can also assume a more or less ideal bending line in the manner of a freely resting beam. In particular, there can be a plurality of bearing points of the gripper shaft. The bearing points can be distributed over the length of the gripper shaft. As a result of these bearing points, the shape change by means of the bearing points can be initiated preferably at a plurality of points along the gripper shaft. The deformation forces can also be transmitted from the gripper bridge to the gripper shaft, not only by the terminal bearing points, but preferably also by the plurality of bearing points. The plurality of bearing points can result in a coupling of gripper bridge and the gripper shaft which can be effective over substantially the entire length of the gripper shaft, so that the two parts can assume bending lines which are substantially identical or approximately identical. In other words, there preferably is essentially no relative movement between the gripper and the gripper support. The material being printed is not moved.

It can also be advantageous if the area in which the material is thinner can be formed by a reduced cross section of the material of the gripper bridge. This zone with a reduced cross section can increase the elasticity at this point, as a result of which elasticity bearing conditions can be achieved which make it possible to achieve the desired curve of the bending line.

The pivot point taught by the present invention can be formed either by a pivot bearing point or at least by a relatively small area of contact with an abutment. Ideally, for one possible embodiment of the present invention, a pivot bearing point can make possible an angular displacement resulting from the bending of the gripper bridge system. But even contact over a relatively small area, i.e. contact with an abutment against which abutment the gripper bridge can be pressed by the bending force, can make possible an angular displacement of the corresponding area of the gripper bridge system relative to the axial direction.

It can be advantageous, in a possible alternative embodiment of the present invention, if the gripper bridge can preferably be mounted on the feed cylinder by means of spacers. These spacers, together with the connecting points, if any, between the gripper bridge and the respective spacers, and/or between the spacer and the connection to the feed cylinder, can also act as pivot points and/or zones where the material is preferably thinner, and thereby can make possible the realization of the bending line taught by the present invention.

As mentioned above, the gripper bridge system is preferably bent by means of a bending device. The concrete design and construction of this bending device are not essential to the realization of the present invention. What is important is that this bending device be able to transmit one or more bending forces to the gripper bridge system at the desired chronological intervals. The bending device can introduce a bending force essentially in the center of the longitudinal dimension of the gripper bridge system.

Alternatively, in another possible embodiment of the present invention, it can also be possible that, for example, two or more bending forces can also be transmitted to the gripper bridge system. The individual forces can be applied at points which are preferably distributed over the longitudinal dimension of the gripper bridge. The bending line between two applied forces is preferably a substantially circular arc.

The above discussed embodiments of the present invention will be described further hereinbelow with reference to the accompanying figures. When the word "invention" is used in this specification, the word "invention" includes "inventions", that is, the plural of "invention". By stating "invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

The accompanying drawings illustrate various embodiments of the invention, wherein.

DESCRIPTION OF THE PREFERRED EMBODIMENT

Figure 1:
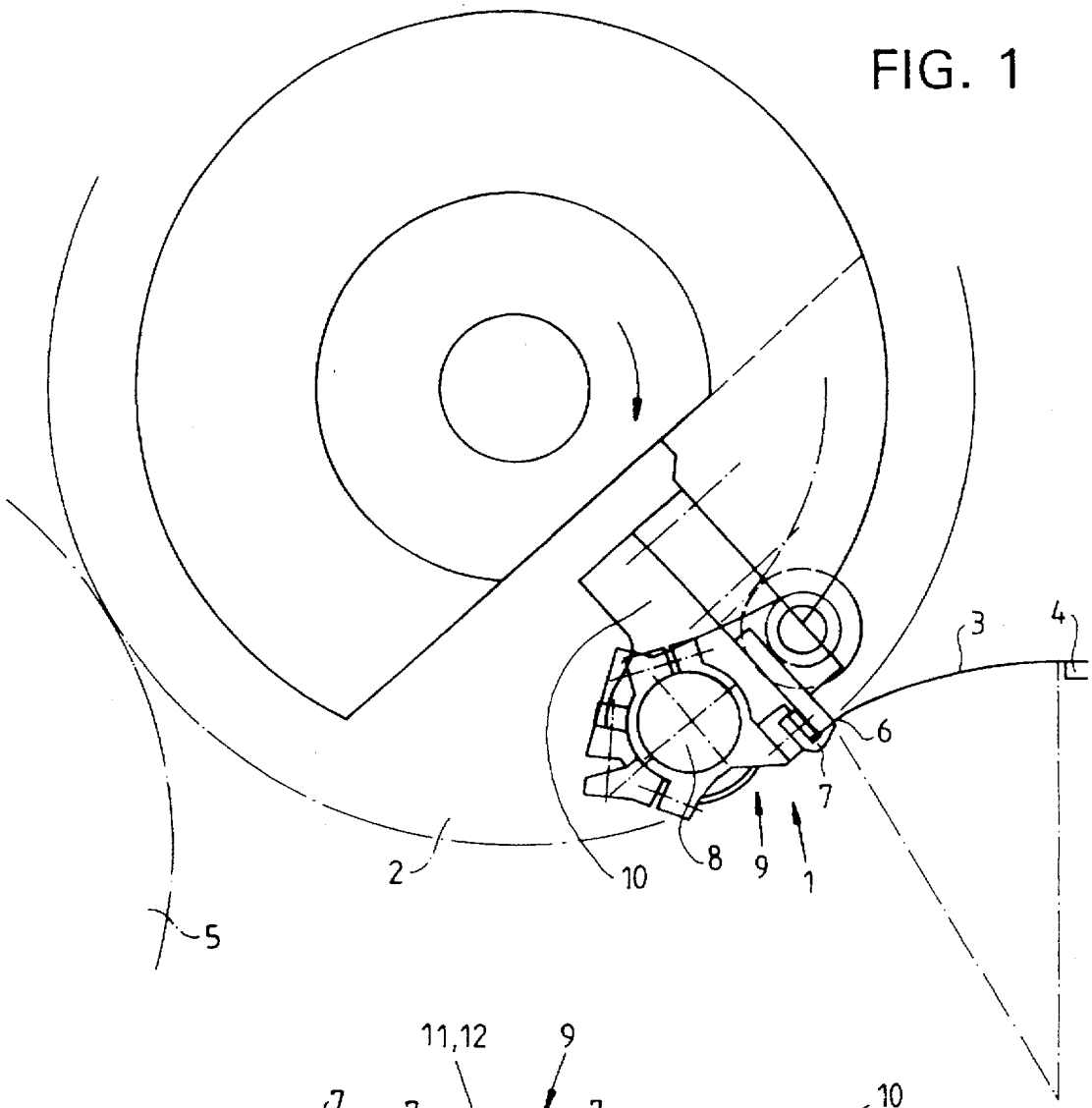
FIG. 1 is a side view of a sheet transfer device.

FIG. 1 shows a sheet transfer device 1 which can be located on a feed cylinder 2. The sheet transfer device 1 can be used to transfer a sheet 3 to be printed from a feed table or landing table or layout table 4 to a printing cylinder 5. For this purpose, the sheet 3 can be held by a clamping action on the front edge 6 of the sheet 3 by grippers 7. The sheet 3 can be accelerated from the velocity 0 [zero] (on the landing table 4) to the velocity of the printing cylinder 5. The grippers 7 can be actuated by means of a gripper shaft 8. The grippers 7 and the gripper shaft 8 can be part of a gripper bridge system 9, which gripper bridge system 9 can include a gripper bridge 10.

Figure 2:
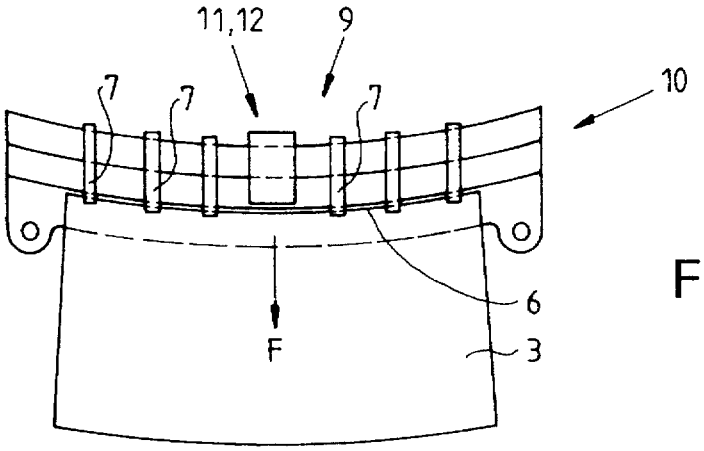
FIG. 2 is a schematic view of the device illustrated in FIG. 1, whereby the deformation of the front edge of a sheet which is being held by the grippers of the sheet transfer device is visible.

There can also be a bending device 11, the design and construction of which bending device 11 need not be described in any further detail, because they are not essential to the teaching of the present invention. The only aspect which is important is that the bending device 11—as illustrated in FIG. 2—is able to exert a force F on the gripper bridge system 9, preferably on the gripper bridge 10, such that there preferably is an elastic bending. This bending can occur by means of an eccentric cam 12 and can be performed rhythmically, preferably as a function of the number of transfer processes.

In other words, for a possible embodiment, FIG. 1 shows the sheet transfer device 1, preferably located on the feed cylinder 2, to feed the sheet 3 to the printing cylinder 5. At take-up, the relative velocity of the grippers 7 with respect to the sheet 3 can essentially be zero to permit the gripping of the sheet 3 by the grippers 7. At the completion of transport of the sheet 3 to the printing cylinder 5, the sheet 3 can be accelerated so that the relative velocity of the outer cylindrical surface of the printing cylinder 5 with respect to the sheet 3 can essentially be zero for the transfer of the sheet 3 to the printing cylinder 5.

The bending device 11 can apply the force F on the gripper bridge system 9, preferably to cause an elastic bending deformation of the gripper bridge 10. The bending deformation of the gripper bridge 10 can approximate the deformation of a freely-resting or simply supported beam.

An example deformation apparatus or bending device 11 that could be adapted for use in the context of the present invention could be disclosed by U.S. Pat. No. 4,466,350, which is incorporated by reference herein. In the known bending device, a gripper shaft is carried by bearings mounted on a gripper bridge. A middle bearing is mounted in a bearing movable about a point of rotation substantially in or opposite the rotational direction of a feed cylinder. The point of rotation is determined by a support arm carrying the middle bearing. The position of the middle bearing is determined by a cam mounted in a fixed bearing on the gripper shaft, and, during the swinging movement of the gripper shaft, can engage a roller mounted on a bracket of the support arm. The cam can exert a force that is transferred to the gripper bridge, the force transferred to the gripper bridge corresponding to the force F in FIG. 2, that can bend or cause a bending deformation of the gripper bridge.

As shown in FIG. 2, the sheet 3 can be picked up in the vicinity of its (the sheet 3) front edge 6 by means of the gripper 7. Then, the gripper bridge system 9 can be bent, as a result of which bending a curved shape can be imparted to the front edge 6 (of the sheet 3). As a result, the rear edge of the sheet 3 can be stretched taut, so that it can become possible to control the registration. If this process is performed upstream of the first printing unit, the device can be called a "paper compensator". If such a device is also located upstream of additional printing units, the term "image controllers" can be used.

Figure 3:
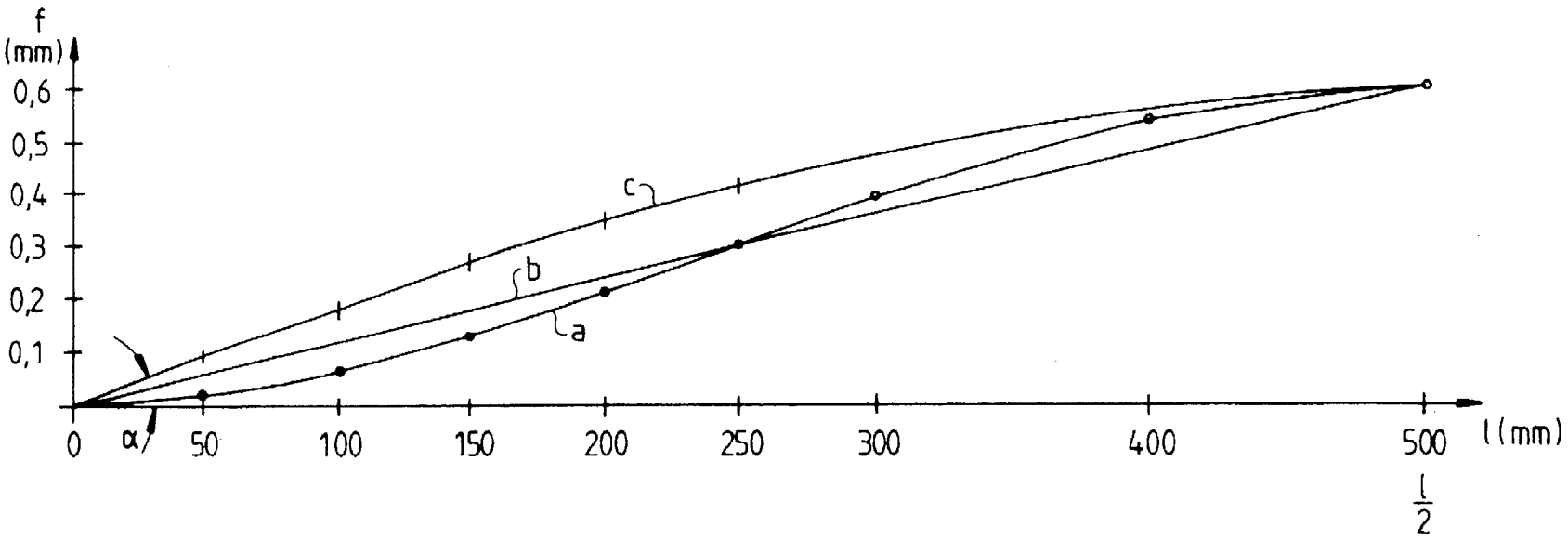
FIG. 3 is a diagram which shows the bending of the gripper bridge system as a function of the distance along its longitudinal dimension (to the center)

FIG. 3 illustrates different bending lines a, b and c to show the bending of the gripper bridge system 9. The longitudinal dimension of the gripper bridge 10 is shown on the abscissa, whereby the total length equals 1 and only half of the total length, i.e. ½, is shown. The displacement is shown on the ordinate, whereby a diagram can be drawn so that preferably the maximum is about 0.6 mm and is located in the center, i.e. at ½ of the current displacement or deflection.

The bending lines a and b relate to known devices. When the gripper bridge system 9 is clamped in a fixed position on the ends, as disclosed in Unexamined German Patent Application 31 12 964, it (the gripper bridge system 9) can correspond to a beam which is clamped fast at both ends, resulting in the bending line a. In the vicinity of the clamping (for length l=0), the bending line can run in the axial direction. In the diagram (FIG. 3), the axial direction is represented by the abscissa. The bending line b can result when the gripper bridge 10 is divided in the middle; in other words, for an embodiment in which the gripper bridge 10 is not continuous, but includes two halves which can be connected to one another centrally by means of coupling elements.

The bending line c corresponds to the ideal shape of a static beam known from strength theory with a constant cross section, which is in linear contact with bearings on both its ends, whereby preferably one bearing also permits an axial movement. With reference to the object of the invention, a bending line in accordance with the invention can also considered to be ideal even if this axial movement is not possible. The present invention teaches that for a possible embodiment, the bending line c can run at an angle of approximately 0.1 degrees, for example, from the axial direction in the vicinity of the bearing, i.e. at the point l=0, and that in the center, i.e. at the point l=½, there can be a turning point, on both sides of which there can be a curve which has a continuous curvature. In Case b, the situation is different on account of the separation; at this point, there is a corner.

In other words, FIG. 3 illustrates three different deflection curves a, b, and c, in which each deflection curve a, b and c can correspond to a different gripper bridge system. Curve "a" can be representative of the deflection of the known gripper bridge system disclosed in German Unexamined Patent Application 31 12 964. This curve "a" can correspond to the deflection of a fixedly-supported beam, that is, a beam having a fixed support at either end of the beam, the beam also having a uniform cross section. Curve "b" can be representative of the deflection of the known gripper bridge system disclosed in U.S. Pat. No. 3,125,022, in which gripper bridge system the gripper bridge is divided in the middle. Curve "c" can be representative of the gripper bridge system of the present invention, and can correspond to the deflection of a simply-supported beam, that is, a beam having a simple support at either end of the beam, the beam having a uniform cross section.

FIG. 3 illustrates the deflection of the beam as a function of the axial location "l" along the beam. As shown in FIG. 3, the deflection for only one-half of the length of the beam is shown, because the deflection is substantially symmetric with respect to the other half of the beam. The abscissa, or X-axis, of FIG. 3 represents the distance "l" along the length of the beam from an end of the beam. The ordinate, or Y-axis, of FIG. 3 represents the deflection of the beam caused by a force substantially perpendicular to the longitudinal axis of the beam and acting at the center of the beam. The half-length of the example beams illustrated in FIG. 3 is 500 millimeters, but the length of the beams can be normalized so that the beam has a length of 1 unit, and so the half-length of the beams has a length of ½ unit as illustrated below the X-axis in FIG. 3. The deflection is in the direction of the applied bending force, and is shown in FIG. 3 in units of millimeters.

Curve "a" shown in FIG. 3 can represent the deflection of a fixedly-supported beam. Because the ends of the gripper bridge of the gripper bridge system disclosed in German Unexamined Patent Application 31 12 964 are essentially fixed and clamped and not free to rotate, the gripper bridge of that known device can be modeled as a fixedly-supported beam. In a fixedly-supported beam, a bending moment can be generated at both ends of the beam to maintain the angular orientation of the ends of the beam. Hence, if the ends of the unloaded beam are assumed to be parallel to the X-axis in FIG. 3, the ends of the beam will remain parallel to the X-axis after the application of force to deform the beam. This can be seen in FIG. 3, where the curve "a" can be considered to be tangential with the X-axis at the origin (i.e., a clamped end of the beam). However, the deformation curve is somewhat "S" shaped in that at the center of the beam (where the deflection is greatest), the beam again becomes parallel with the original longitudinal axis of the beam (that is, curve "a" essentially becomes parallel with the X-axis at the center of the beam).

Curve "b" shown in FIG. 3 can represent the deflection of the known gripper bridge system disclosed in U.S. Pat. No. 3,125,022, in which the gripper bridge is divided in the middle. Because the gripper bridge system includes a divided, and not continuous, bridge beam construction, curve "b" illustrates the deformation of one of the two separate bridge beams or gripper shafts of the known device. Deformation of the other bridge beam or gripper shaft would be symmetrical with the curve "b" shown.

As shown in curve "" of FIG. 3, the end of the beam can pivot with respect to the longitudinal axis. However, the deformation curve is essentially a straight line, and maintains a substantially constant slope with respect to the original longitudinal axis of the beam. The two separate bridge beams of this known device would therefore deform and form a "V" shape. Rather than being parallel with the original longitudinal axis at the center of the where the two bridge beams meet, a discontinuity is created, represented by the vertex of the "V" as a sudden change in slope between the two separate beams can occur.

Curve "c" shown in FIG. 3 can represent the deflection of the gripper bridge system 9 realized in accordance with the present invention. Curve "c" represents the deflection of a freely-supported beam or simply-supported beam. The gripper bridge 10 realized in accordance with the present invention can essentially be seen as or can essentially approach the behavior of a simply-supported beam. In a simply-supported beam, the ends of the beam can pivot or angularly deflect in reaction to an applied force. Hence the bending moments or forces generated at the ends of a fixedly-supported beam are, for practical purposes, eliminated. As shown in Curve "c" of FIG. 3, the end of the curve "c" is not tangential with the X-axis, and instead forms an angle [alpha] with the X-axis. The shape of the deformation curve represented by curve "c" is substantially circular in shape. And like the fixedly-supported beam represented by curve "a", the center of the beam represented by curve "c" can return essentially to parallel with the original longitudinal axis of the beam, that is, the center of the beam is again substantially parallel to the X-axis at l=½ units.

It has been shown that a bending of the gripper bridge system 9 along bending line c, or approximately along the curve of the bending line c, can result in essentially an optimal registration correction with relatively little application of force. This bending line c can be realized more or less by means of the systems illustrated in FIGS. 4 to 14.

In other words, it has been shown that a bending of the gripper bridge system 9 approximately or substantially along the line of curve "c" of FIG. 3, that is, substantially in the form of the bending of a simply-supported beam, can result in an improved registration correction ability of the gripper bridge system 9. The shape of the bending of the gripper bridge system 9 can essentially eliminate the substantially non-deformed ends of the known gripper bridge systems represented by curve "a" of FIG. 3, and can eliminate the discontinuity of the deformed shape of the known gripper bridge systems represented by curve "b" of FIG. 3.

In addition, the bending of the gripper bridge system 9 substantially in the form of a simply-supported beam can allow a satisfactory deformed shape to be generated with relatively little application of force. For example, to achieve the same maximum elastic deflection of two identically center-loaded beams, the first beam being simply-supported and the second beam being fixedly-supported, the fixedly-supported beam theoretically requires a force four times larger than the force applied to the simply-supported beam. Therefore, the force required to achieve a maximum deformation of the gripper bridge system 9 realized in accordance with the present invention can be substantially less than in known gripper bridge systems.

Figure 4:
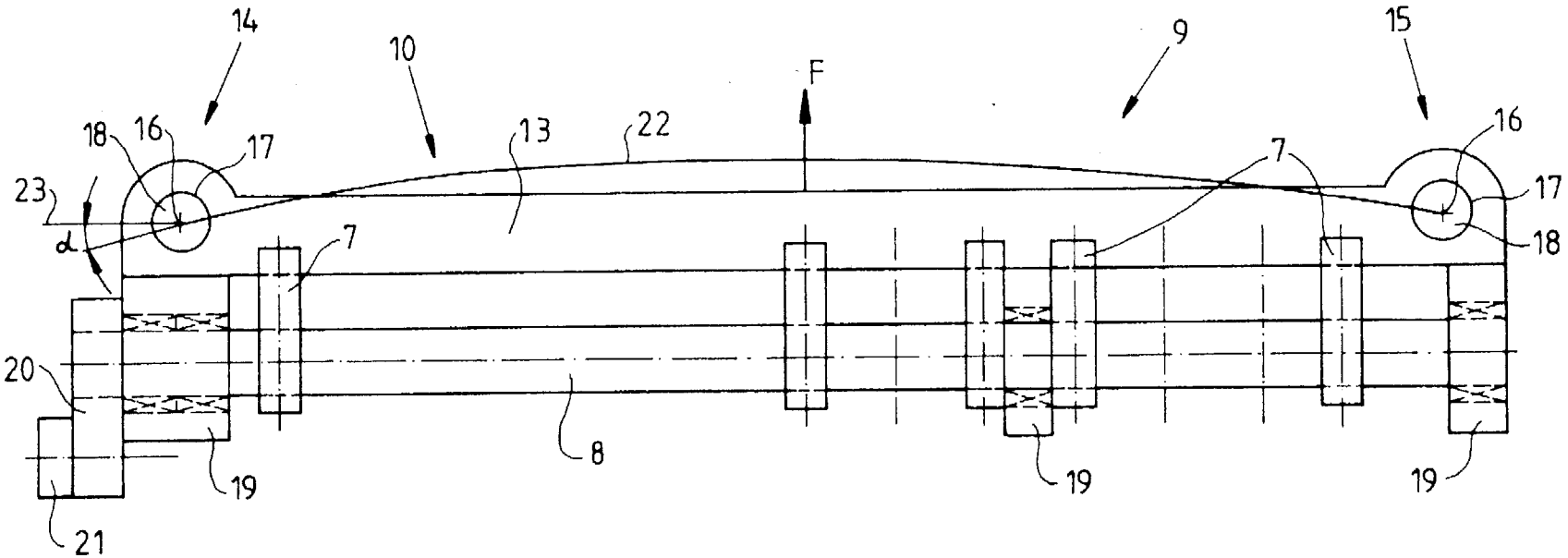
FIG. 4 is an overhead view of a gripper bridge system.

In the following description, therefore, detailed discussion will be devoted only to FIGS. 4 to 14, i.e. to various embodiments of gripper bridge systems 9, or corresponding bearing points of the gripper bridge 10 gripper support bar 13. For example, FIG. 4 shows a gripper bridge 10 which preferably has pivot points 16 in the vicinity of its two ends 14 and 15. The pivot points 16 are preferably realized in the form of pins or bolts 18, which pins 18 can run through borings 17 in the gripper bridge 10, and in this manner make possible a pivoting movement or an angular displacement. Horizontal pedestal bearings or pillow blocks 19 can proceed from the gripper bridge 10 in the terminal areas 14 and 15. Additional pedestal bearings 19 can be located at uniform intervals over the longitudinal dimension of the gripper bridge system 9, of which only one additional bearing 19 is shown in FIG. 4, for purposes of simplicity.

Mounted in the pedestal bearings 19 is the gripper shaft 8, which gripper shaft 8 has the grippers 7. Here, too, for purposes of simplicity, only a few of the grippers 7 are shown. The gripper shaft 8 can be non-rotationally connected to a roller lever 20, the cam roller 21 of which interfaces with a cam (not shown), by means of which the grippers 7 can be actuated. By means of the bending device 11 (not shown), a force F can be exerted—preferably in the center of the longitudinal dimension of the gripper bridge 10—which force F can result in the realization of the bending line 22 of the gripper bridge system 9. It can be apparent that as a result of the presence of the pivot points 16, the angle [alpha] between the bending line 22 and the axial direction 23 can be realized. The bending line 22 can correspond to the desired bending line c shown in FIG. 3.

Figure 5:
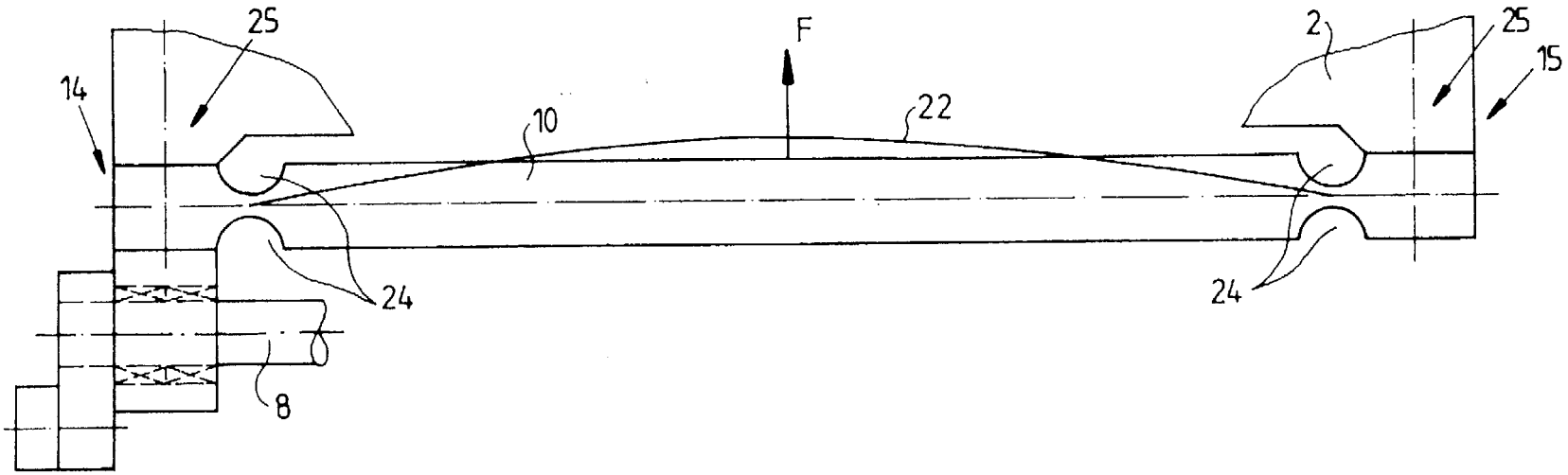
FIG. 5 is an overhead view of an additional embodiment of a gripper bridge system.

FIG. 5 shows an additional embodiment which is essentially the same as the embodiment illustrated in FIG. 4. Therefore, the following paragraph will explain only the substantial differences between the two embodiments. Instead of the pivot points 16 in the terminal areas 14 and 15 of the gripper bridge 10, there can be zones 24 where the material is thinner. These zones 24, where the material is thinner, can each be realized in the form of a reduced cross section of the gripper bridge 10. The ends 14 and 15 which are on the far sides of the zones 24 of thinner material can be connected essentially superficially or flat with parts of the feed cylinder 2.

Figure 5A:
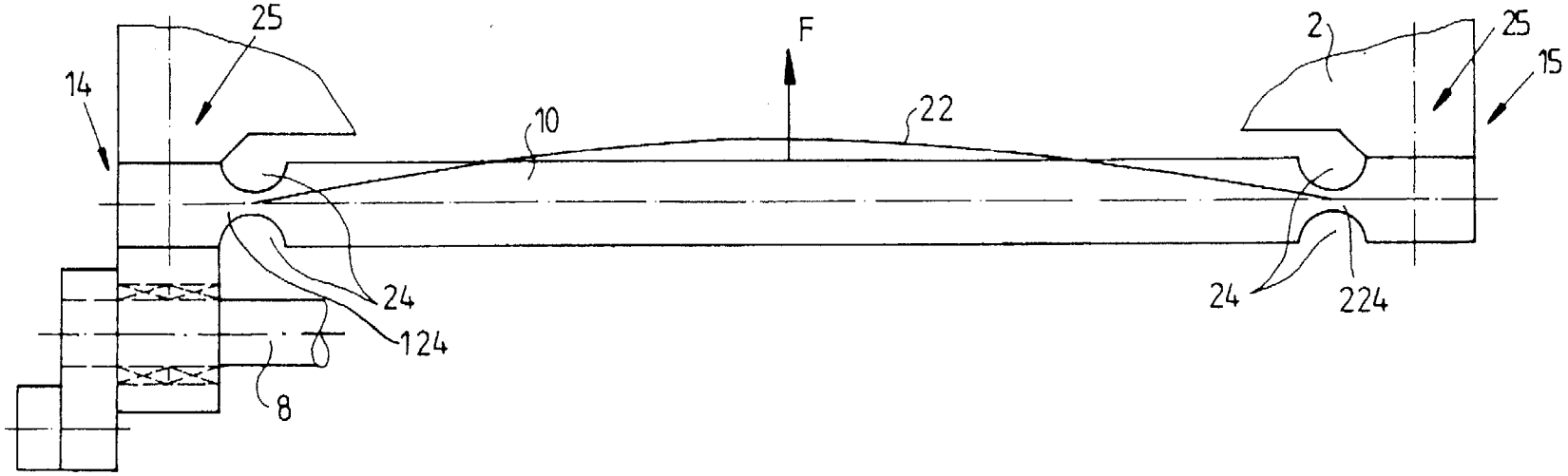
FIG. 5*a* is similar to FIG. 5 and includes additional reference numerals.

In other words, for a possible embodiment, FIG. 5 illustrates an alternative construction to permit the bending of the gripper bridge system 9 to approach the deformation of a simply-supported beam. Located at each end of the beam or gripper bridge 10 can be zones 24 to form a reduced cross section or neck 124 and a reduced cross section or neck 224 (see FIG. 5*a*). The neck 124 can be located adjacent the terminal portion 14, and the neck 224 can be located adjacent the terminal portion 15. Each neck 124 and 224 can, on account of their reduced cross section, be relatively much more flexible as compared to the portion of the gripper bridge 10 between the necks 124 and 224. The necks 124 and 224 can therefore, in essence, act as simple supports of the bridge beam 10 located between the necks 124 and 224. The necks 124 and 224 can perform the function of pivot points analagous to the pivot points 14 and 15 of the embodiment illustrated in FIG. 4. The gripper bridge 10 located between the necks or pivot points 124 and 224 can therefore assume the bending shape 22, corresponding to curve c of FIG. 3, and can assume substantially or approximately the shape of a simply-supported beam under the action of the bending device 11.

Fastening means 25 were not illustrated in any further detail, because they can be realized in any manner which is appropriate. Threaded fasteners can be used, for example. The decisive factor is that on account of the zones 24 where the material is thinner, elastic characteristics can be created which can make possible the realization of a bending line 22 when a force F is applied, so that the desired bending line c illustrated in FIG. 3 can be created. At the expense of a minor deviation from the bending line of the gripper shaft 8, the position of the roller lever 20 can essentially remain unchanged, so that the cam roller 21 does not cross over on a cam (not shown), that is, so that the cam roller 21 on a cam (not shown) does not cross over.

In other words, because the neck portions 124 and 224 can essentially act as simple supports or pivot points, the fastening of the terminal areas 14 and 15 can be realized in any manner which is appropriate for a particular embodiment; the fasteners of the terminal areas 14 and 15, in a possible embodiment of the present invention, do not necessarily have to form the simple supports or pivoting axes 16 of the gripper bridge 10.

Figure 6:
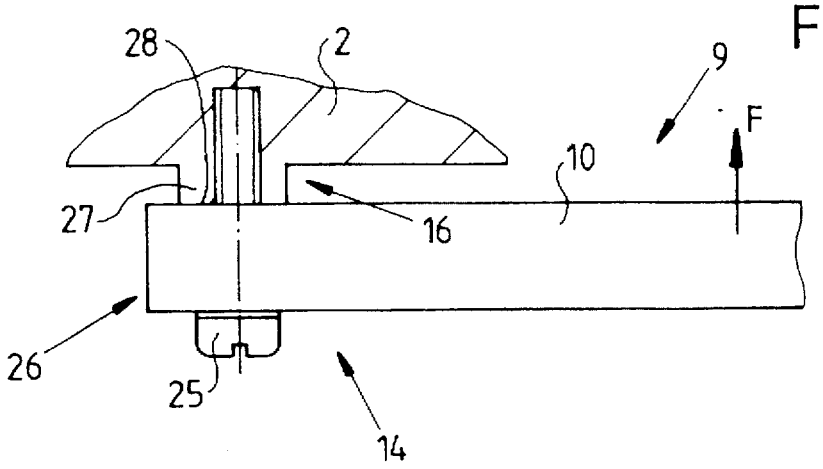
FIG. 6 is an overhead view of one bearing point of a gripper bridge on a feed cylinder of the sheet transfer device.

FIG. 6 illustrates a bearing area 26 of one end 14 of the gripper bridge 10 on the feed cylinder 2. The other terminal area 15 is not shown, for purposes of simplicity, but can be realized in a corresponding manner. For the realization of a pivot point 16, the feed cylinder 2 can have a raised support 27 for the realization of a relatively small contact surface 28. The gripper bridge 10 can be fastened by means of suitable fastening means 25 (for example, by means of a threaded fastener or a similar device) to the feed cylinder 2 so that the gripper bridge 10 can come in contact with the contact surface 28. If a force F is then applied by a bending device (not shown), the gripper bridge system 9 can be deformed along the bending line c shown in FIG. 3.

Figure 7:
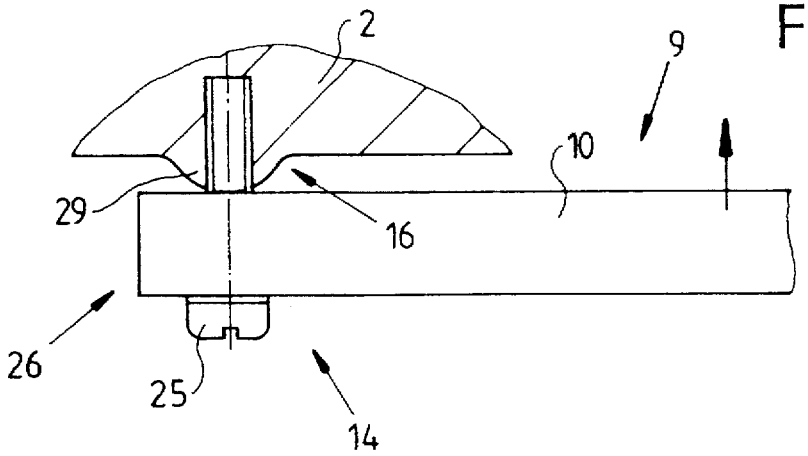
FIG. 7 shows an additional embodiment of a bearing point.

FIG. 7 shows an embodiment which is similar to the one illustrated in FIG. 6. However, the elevated contact surface 27 preferably has a rectangular cross section. The elevated contact surface 27 can be realized, for a possible embodiment, in the form of a spherical or curved elevated contact surface 29. The spherical contact surface 29 can result in the realization of a bending line, which bending line can correspond closely to the ideal line with a relatively small application of force.

In other words, the contact surface of the feed cylinder 2 can be formed as an abutment; the abutment can have a rectangular cross-section as shown, in a possible embodiment, for the elevated contact surface 27 as shown in FIG. 6, or the abutment can have a spherical or curved elevated contact surface 29, in an alternative embodiment, as shown in FIG. 7.

Figure 8:
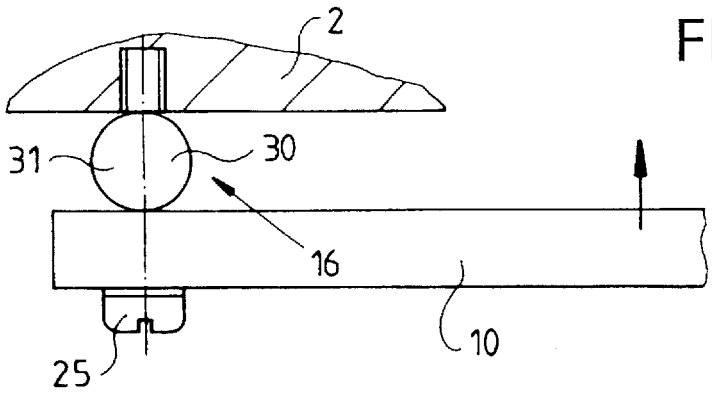
FIG. 8 shows an additional embodiment of a bearing point.

FIG. 8 shows an additional embodiment which differs from the embodiments illustrated in FIGS. 6 and 7 in that an additional element, namely a spacer 30, is used. The spacer 30 can be located between the feed cylinder 2 and the gripper bridge 10. The spacer 30 can be held by means of suitable fastening means 25. In the embodiment illustrated in FIG. 8, the spacer 30 can be realized in the form of a cylinder 31, which cylinder 31 can be penetrated by the shank of a screw which forms the fastening means 25. The shank of the screw of the fastening means 25 can also penetrate a boring in the gripper bridge 10 and can be screwed into a threaded hole in the feed cylinder 2. The head of the screw of the fastening means 25 can be supported on the gripper bridge 10. Overall, this construction once again preferably results in a pivot point 16.

Figure 9:
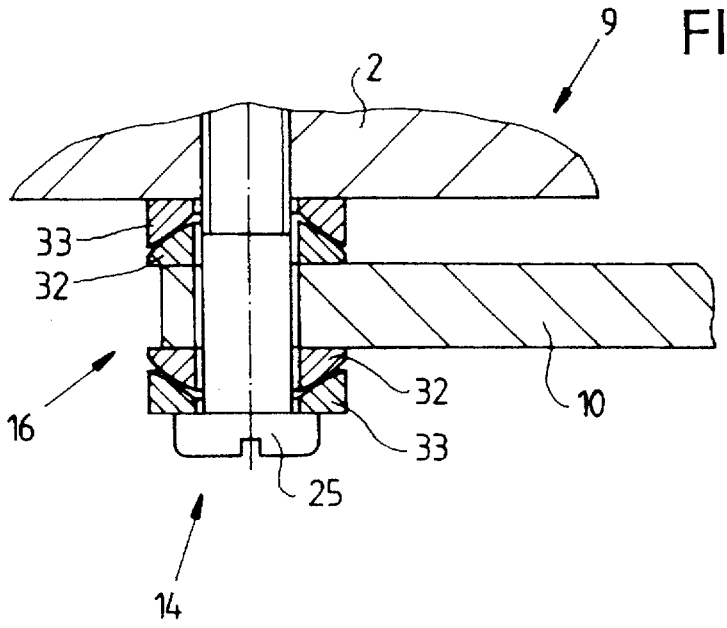
FIG. 9 shows an additional embodiment of a bearing point.

FIG. 9 shows an embodiment of a pivot point 16 formed by spherical discs 32. The spherical discs 32 can be located on both sides of the gripper bridge 10. The spherical discs 32 can be held in place with conical sockets 33 by fastening means 25. The fastening means 25 can be connected to the feed cylinder 2, whereby the fastening means 25 used can preferably once again be a threaded fastener. The spherical discs 32 and the conical sockets 33 can be realized in the form of appropriately shaped washers or discs.

Figure 10:
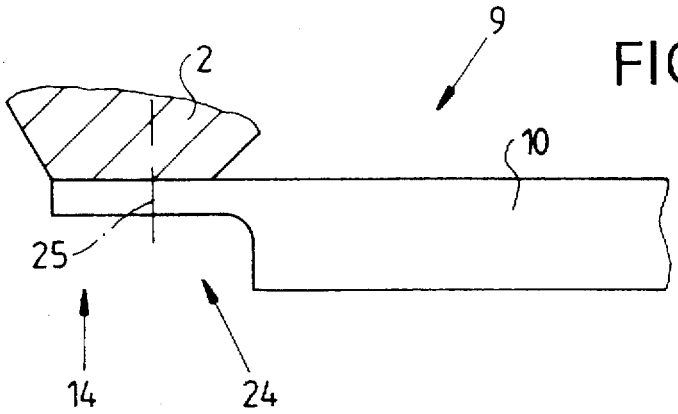
FIG. 10 shows an additional embodiment of a bearing point.

FIG. 10 illustrates one embodiment of a bearing in which there is a zone 24 in which the material is thinner. This zone 24 can be realized in the form of a reduction of the cross section on one side of the gripper bridge 10 on the end 14, and by fastening the reduced cross section of zone 24 to the feed cylinder 2 by fastening means 25. The zone 24 of thinner material preferably forms an elastic zone 24. The preferably elastic zone 24 can make it possible to realize a bending line of the gripper bridge 10, which bending line can correspond to the bending line c shown in FIG. 3.

Figure 11:
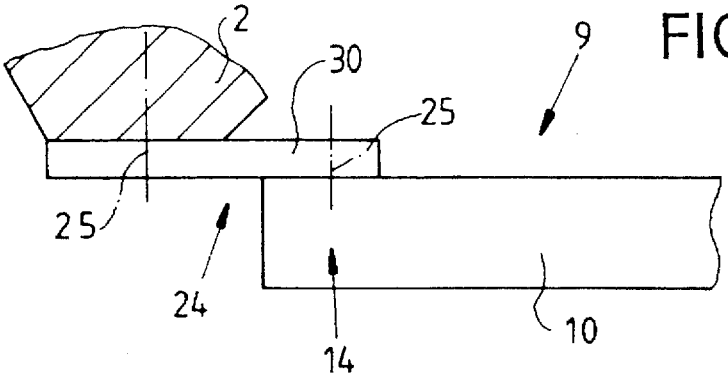
FIG. 11 shows an additional embodiment of a bearing point.

FIG. 11 illustrates an embodiment in which a spacer 30 is once again used. In this embodiment, the spacer 30 can be in the form of a bar or rod. One end of the spacer 30 can be connected by means of fastening means 25 to the end 14 of the gripper bridge 10, and the other end of the spacer 30 can be fastened to the feed cylinder 2, again by suitable fastening means 25. Overall, therefore, a zone 24 of thinner material can therefore be realized, which zone 24 of thinner material can make it possible to achieve the desired bending line of the gripper bridge system 9.

Figure 12:
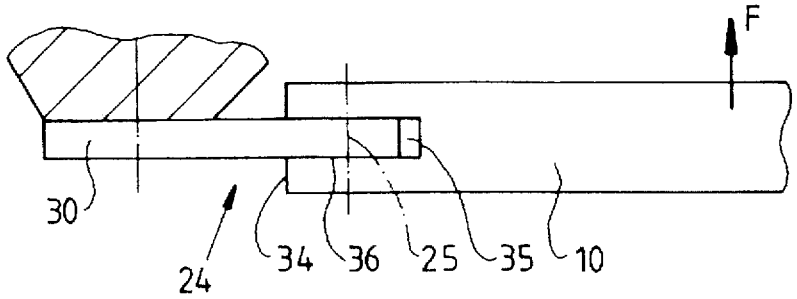
FIG. 12 shows an additional embodiment of a bearing point.

FIG. 12 illustrates an embodiment which is similar to the embodiment illustrated in FIG. 11. The only substantial difference is that the gripper bridge 10 is not fastened with one side on the spacer 30. The gripper bridge 10 can have an open-edged recess 35, which open-edged recess 35 preferably begins at the end surface 34. In the recess 35, the bar or rod-shaped spacer 30 can be engaged, and the spacer 30 can be fastened by means of fastening means 25. The open-edged recess 35 can run in the axial direction, whereby a slot 36 can be formed. The plane of slot 36 can be substantially perpendicular to the plane of the paper, while the force F can lie in the plane of the paper.

Figure 13:
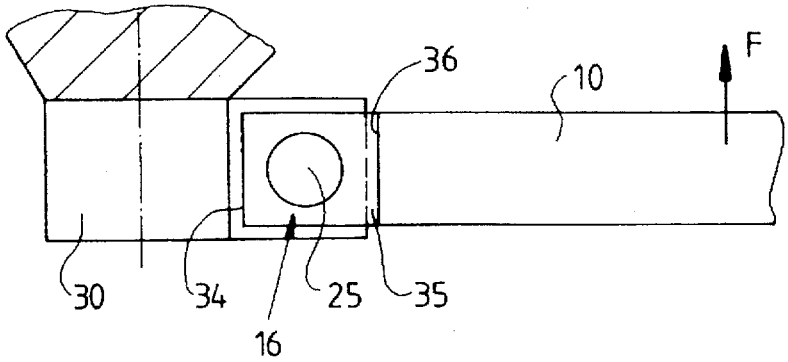
FIG. 13 shows an additional embodiment of a bearing point.

FIG. 13 is similar to the embodiment illustrated in FIG. 12, but the plane of the slot 36 preferably lies in the plane of the paper. The axis of the fastening means 25 can also be offset by about 90 degrees, so that this axis of the fastening means 25 can form a pivot point 16.

In the embodiment illustrated in FIG. 12 on the other hand, a zone 24 of thinner material can essentially be formed.

In other words, for a possible embodiment, the zone 24 of thinner material can be formed or included on a fastener or spacer 30, the fastener or spacer 30 being part of a fastener arrangement to attach the gripper bridge 10 to the feed cylinder 2. The fastener or spacer 30 can be fastened, as part of the fastening arrangement, to the feed cylinder 2 by fastening means 25. In other possible embodiments, the fastening means 25 can include the zone 24 of thinner material to permit pivoting of the ends of the gripper bridge 10.

Figure 14:
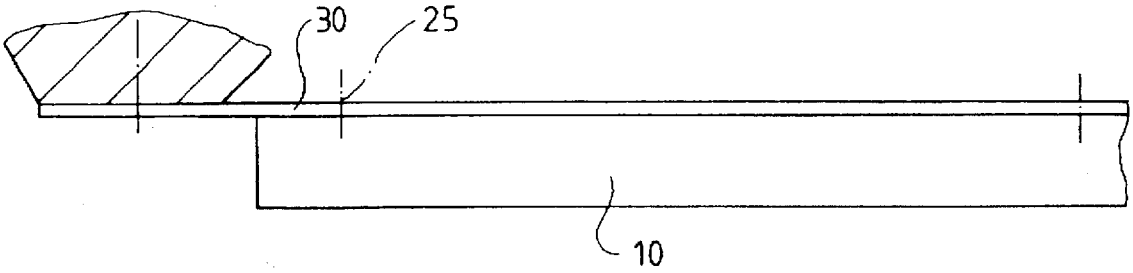
FIG. 14 shows an additional embodiment of a bearing point.

FIG. 14 illustrates an embodiment which is similar to the embodiment illustrated in FIG. 11. The only substantial difference is that the bar or rod-shaped spacer 30 can be realized so that it (the spacer 30) can be relatively long, and accordingly, the spacer 30 can extend over a relatively large axial area of the gripper bridge 10. In this area there preferably are at least two fastening means 25—at some distance from one another—whereby different bending characteristics can be created. These other bending characteristics can result from the fact that there can be a relatively extensive overlap between the spacer 30 and the gripper bridge 10.

In other words, for possible embodiments of the present invention, each pin 18 or fastening means 25 can have an axis oriented substantially perpendicular to the direction of the applied force F applied by a bending device 11 (as for example, the embodiments illustrated in FIGS. 4 and 13). The axis of each of the pins 18 or fastening means 25 can therefore form a corresponding pivoting point 16 or pivoting axis of an end of the gripper bridge 10, to allow the gripper bridge 10 to deform substantially in the manner of a simply-supported beam.

In other possible embodiments of the present invention, the pins 18 or the fastening means 25 can have an axis substantially parallel to the force F applied by a bending device 11 (as for example, FIGS. 5 and 6). In these embodiments, the axis of each pin 18 or fastening means 25 cannot form the pivoting point 16 or pivoting axis of an end of the gripper bridge 10, because each pivoting axis is substantially perpendicular to the direction of the applied force F. Therefore, for these embodiments, the pivoting point 16 or pivoting axis of each end of the gripper bridge 10 can be formed, for possible alternative embodiments, from a reduced cross section area (as for example, the embodiments illustrated in FIGS. 5 and 12) or from a relatively small contact area at each end of the gripper bridge 10 (as for example, the embodiments shown in FIGS. 6, 7 and 8). The pivoting point 16 or pivoting axis formed can allow the gripper bridge 10 to deform substantially in the manner of a simply-supported beam.

In other possible embodiments of the present invention, the axis of the pin 18 or fastening means 25 on one side of the gripper bridge 10 can be oriented substantially parallel with the direction of the applied force F, and the axis of the pin 18 or fastening means 25 on the opposite end of the gripper bridge 10 can be oriented substantially perpendicular to the direction of the applied force F, to meet particular design requirements.

In other words, the present invention teaches that the gripper shaft 8 can be mounted to the feed cylinder 2 preferably in a manner that permits the gripper shaft 8 to deform as a simply-supported beam, that is, the ends of the gripper shaft 8 can pivot or undergo an angular displacement in reaction to the force F applied by the deflection device 11. For a possible embodiment of the present invention, gripper shaft 8 can have a plurality of grippers 7 mounted along the gripper shaft 8 to transfer the sheet 3 along a sheet path, preferably from the feed or layout table 4 to the printing cylinder 5. The gripper shaft 8 can be deformable in response to the force F applied by the deflection device 11.

In accordance with the teachings of the present invention, for a possible embodiment, the gripper shaft 8 can deform in response to the force F in a manner similar to or approximating a freely resting or simply-supported beam. The shaft 8 can be mounted to the feeding cylinder 2 in a manner that can allow each end of the gripper shaft 8 to pivot, or undergo an angular displacement, in response to the bending of the gripper shaft 8 in reaction to the force F applied by the deflection device 11.

The gripper shaft 8 can be mounted to the feed cylinder 2, in a possible embodiment of the present invention, by a mounting apparatus. The mounting apparatus can include the gripper beam 10 and the shaft bearings 19. The bearings 19 can be attached to the gripper beam 10 to rotatably mount and support each end of the gripper shaft 8. As discussed previously, for possible alternative embodiments of the present invention, the gripper bridge 10 can be realized in a manner to approximate the deformation of a freely resting or simply-supported beam in reaction to the application of the force F of the deflection device 11. In possible embodiments of the present invention as shown in FIGS. 4–12, the gripper bridge 10 can include various embodiments of pivot points 16 or necks 124 and 224 (or combinations thereof) to permit the gripper bridge 10 to simulate or approximate the bending deformation of a freely resting or simply-supported beam.

Because each bearing 19 supporting the corresponding end of the gripper shaft 8 can be attached to a corresponding end of the gripper bridge 10, each such bearing 19 can pivot or have an angular displacement in response to the pivoting or angular displacement of the ends of the gripper bridge 10. Because each end of the gripper shaft 8 can be mounted within the corresponding bearing 19, each end of the gripper shaft 8 can also pivot or undergo an angular deformation in reaction to the force F applied by the deformation device 11. Therefore, in accordance with a possible embodiment of the present invention, the gripper shaft 8 can be mounted to the feed cylinder 2 in a manner to permit the gripper shaft 8 to deform approximately in the shape of a freely resting or simply-supported beam to permit a register correction of a sheet.

One feature of the invention resides broadly in the sheet transfer device, in particular a feed cylinder, of a sheet-fed rotary printing press, with a device for registration correction by deforming the leading edge of the sheet by the bending of a gripper bridge system, characterized by the fact that the gripper bridge system 9 has a gripper bridge 10 which extends continuously over the width of the sheet transport path, and is supported in each of its two terminal areas ends 14, 15 by means of a pivot point 16 and/or a zone of thinner material 24 for the realization of a bending line c somewhat similar to a freely resting beam.

Another feature of the invention resides broadly in the sheet transfer device characterized by the fact that the gripper bridge 10 is mounted on the feed cylinder 2 by means of the pivot points 16 and/or the zones of thinner material 24.

Yet another feature of the invention resides broadly in the sheet transfer device characterized by the fact that a continuous gripper shaft 8 is mounted on the gripper bridge 10.

Still another feature of the invention resides broadly in the sheet transfer device characterized by the fact that a plurality of bearing points of the gripper shaft 8 are distributed over the longitudinal dimension of the gripper bridge.

A further feature of the invention resides broadly in the sheet transfer device characterized by the fact that the zone of thinner material 24 is formed by a reduced cross section of the gripper bridge 10.

Another feature of the invention resides broadly in the sheet transfer device characterized by the fact that the pivot point 16 is formed by a small surface contact (contact surface 28) on an abutment (elevated support 27, 29).

Yet another feature of the invention resides broadly in the sheet transfer device characterized by the fact that the gripper bridge 10 is mounted on the feed cylinder 2 by means of spacers 30.

Still another feature of the invention resides broadly in the sheet transfer device characterized by the fact that the gripper bridge system 9 is bent by means of a bending device 11 which introduces a bending force F in the center of the longitudinal dimension of the gripper bridge system 9.

A further feature of the invention resides broadly in the sheet transfer device characterized by the fact that the bending device 11 exerts a plurality of forces F on the gripper bridge system 9, which forces are distributed over the longitudinal dimension of the gripper bridge 10.

The components disclosed in the various publications, disclosed or incorporated by reference herein, may be used in the embodiments of the present invention, as well as, equivalents thereof.

Examples of beams and beam supports, including the derivation of formulas for the linear deflection and angular deflection of beams having different forms of support, including simply-supported beams and fixedly-supported beams, can be found in the publication *Mechanics of Materials*, with authors Ferdinand P. Beer and E. Russell Johnston, Jr. published by McGraw-Hill, Inc., copyright 1981 and having ISBN 0-07-004284-5. Other examples of beam analysis can be found in the publication *Mechanical Engineering Design*, second edition, with author Joseph Edward Shigley, published by McGraw-Hill, Inc., copyright 1972 and having Library of Congress Catalog Card No. 74-167497. Each of these publications are herein incorporated by reference as if fully set forth herein.

Examples of sheet transfer apparatus for use in rotary printing machines that could be adapted for use in accordance with the present invention, as well as other components generally associated with sheet transfer apparatus and rotary printing machines could be disclosed by the following U.S. Patents, all assigned to the assignee of the present invention: U.S. Pat. No. 5,476,041, U.S. Pat. No. 5,473,983, U.S. Pat. No. 5,546,858, U.S. Pat. No. 5,419,256, U.S. Pat. No. 5,385,342, U.S. Pat. No. 5,259,608, U.S. Pat. No. 5,102,117, U.S. Pat. No. 5,096,179, U.S. Pat. No. 5,090,681, U.S. Pat. No. 5,076,165, U.S. Pat. No. 5,054,765, U.S. Pat. No. 4,854,231, and U.S. Pat. No. 4,839,355.

Further examples of sheet transfer apparatus for use in rotary printing machines that could be adapted for use in accordance with the present invention, as well as other components generally associated with sheet transfer apparatus and rotary printing machines could be disclosed by the following U.S. Patents, all assigned to the assignee of the present invention: U.S. Pat. No. 5,596,929, U.S. Pat. No. 5,440,983, U.S. Pat. No. 5,343,806, U.S. Pat. No. 5,231,927, U.S. Pat. No. 5,176,079 and U.S. Pat. No. 5,033,732.

Another example of a sheet transfer apparatus for use in a rotary printing machine that could be adapted for use in accordance with the present invention, as well as other examples of other components generally associated with sheet transfer apparatus and rotary printing machines could be disclosed by the following U.S. Patent Application, assigned to the assignee of the present invention: Ser. No. 07/264,601.

Other examples of sheet transfer apparatus for use in rotary printing machines that could be adapted for use in accordance with the present invention, as well as other components generally associated with sheet transfer apparatus and rotary printing machines could be disclosed by the following U.S. Patents: U.S. Pat. No. 5,125,336, U.S. Pat. No. 4,858,910, U.S. Pat. No. 4,813,353, U.S. Pat. No. 4,718,342, U.S. Pat. No. 4,697,512, U.S. Pat. No. 4,664,032 and U.S. Pat. No. 4,466,350.

Other examples of simply supported or freely supported structures having pivotable ends that could be adapted for use in accordance with the present invention could be disclosed by the following U.S. Patents: U.S. Pat. No. 5,494,309, U.S. Pat. No. 5,364,157, U.S. Pat. No. 5,340,205, U.S. Pat. No. 4,817,842 and U.S. Pat. No. 4,323,073.

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The corresponding foreign patent publication applications, namely, Federal Republic of Germany Patent Application No. 196 11 124.2, filed on Mar. 21, 1996, having inventor Rudi Haupenthal, is incorporated by reference as if set forth in its entirety herein.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clauses are intended to cover the structures described herein as performing the recited function and not only structural equivalents but also equivalent structures.

The invention as described hereinabove in the context of the preferred embodiments is not to be taken as limited to all of the provided details thereof, since modifications and variations thereof may be made without departing from the spirit and scope of the invention.

What is claimed is:

1. A feed cylinder for a sheet-fed rotary printing press, said feed cylinder comprising:

a body having an axis of rotation;

a sheet transfer device to transfer a sheet along a sheet path;

said sheet transfer device comprising a device for registration correction by deforming the leading edge of a sheet being transferred by said sheet transfer device; and said device for registration correction comprising:

a shaft having a longitudinal axis;

a gripping device to grip a sheet for transport along a sheet path;

said gripping device being disposed along said shaft;

a mounting apparatus to mount said shaft to said body of said feed cylinder;

a deflection device to generate a force to deform said shaft and thereby deform a leading edge of a sheet;

said deflection device being operatively connected to said shaft to deform said shaft upon a force being generated by said deflection device;

said mounting apparatus being attached to said body of said feed cylinder;

said shaft comprising a first end portion and an axially opposite second end portion;

each of said first and second end portions of said shaft being rotatably mounted on said mounting apparatus;

said shaft being disposed to be bendable along the axis of said shaft during receipt of a force from said deflection device to deform said shaft and thereby deform a leading edge of a sheet;

said mounting apparatus comprising a pivoting arrangement; and said pivoting arrangement being disposed to permit pivoting of each of said first and second end portions of said shaft during bending of said shaft.

2. The feed cylinder according to claim 1, wherein:

said mounting apparatus comprises a gripper bridge;

said gripper bridge has a longitudinal axis;

said gripper bridge is disposed substantially parallel with the axis of said shaft;

said gripper bridge comprises a first end portion and an axially opposite second end portion;

said first end portion of said shaft is mounted on said first end portion of said gripper bridge; and said second end portion of said shaft is mounted on said second end portion of said gripper bridge.

3. The feed cylinder according to claim 2, wherein:

said gripper bridge is configured to transfer a force between said deflection device and said body of said feed cylinder; and said pivoting arrangement of said mounting apparatus comprises each of said first and second end portions of said gripper bridge being disposed to permit pivoting of said first and second end portions of said gripper bridge upon the transfer of a force between said deflection device and said body of said feed cylinder.

4. The feed cylinder according to claim 3, wherein:

said gripper bridge comprises an intermediate portion;

said intermediate portion of said gripper bridge is disposed between said first and second end portions of said gripper bridge;

said intermediate portion of said gripper bridge comprises a cross-section area disposed substantially perpendicular to the axis of said gripper bridge;

said mounting apparatus comprises a first fastening arrangement and a second fastening arrangement;

said first fastening arrangement is disposed to fasten said first end portion of said gripper bridge to said body of said feed cylinder;

said second fastening arrangement is disposed to fasten said second end portion of said gripper bridge to said body of said feed cylinder;

each of said first and second end portions of said gripper bridge are fastened to said body of said feed cylinder;

said first end portion of said gripper bridge being disposed to permit pivoting comprises one of the following sets of characteristics A) and B):

A) said first end portion of said gripper bridge comprises a pivoting portion; and said pivoting portion of said first end portion of said gripper bridge is configured to pivot about a first pivoting axis;

B) one of: said first end portion of said gripper bridge and said first fastening arrangement comprises a first portion;

said first portion of said one of said first end portion of said gripper bridge and said first fastening arrangement comprises a cross-section area disposed substantially perpendicular to the axis of said gripper bridge; and said cross-section area of said first portion is substantially less than the cross-section area of said intermediate portion of said gripper bridge; and said second end portion of said gripper bridge being disposed to permit pivoting comprises one of the following sets of characteristics C) and D):

C) said second end portion of said gripper bridge comprises a pivoting portion; and said pivoting portion of said second end portion of said gripper bridge is configured to pivot about a second pivoting axis; and D) one of: said second end portion of said gripper bridge and said second fastening arrangement comprises a second portion;

said second portion of said one of said second end portion of said gripper bridge and said second fastening arrangement comprises a cross-section area disposed substantially perpendicular to the axis of said gripper bridge; and said cross-section area of said second portion is substantially less than the cross-section area of said intermediate portion of said gripper bridge.

5. The feed cylinder according to claim 4, wherein:

said mounting apparatus comprises a first bearing;

said first end portion of said shaft is mounted within said first bearing to rotatably mount said first end portion of said shaft;

said first bearing is attached to said first end portion of said gripper bridge;

said mounting apparatus comprises a second bearing;

said second end portion of said shaft is mounted within said second bearing to rotatably mount said second end portion of said shaft;

said second bearing is attached to said second end portion of said gripper bridge;

said mounting apparatus comprises at least one third bearing;

said at least one third bearing is disposed between said first and second bearings;

said shaft rotatably extends through said at least one third bearing to at least partially support said shaft; and said at least one third bearing is attached to said gripper bridge between said first and second bearings;

said shaft comprises a center portion;

said center portion of said shaft is disposed substantially equidistant from said first and second end portions of said shaft;

said deflection device comprises one of the following E) and F):

E) said deflection device is disposed to generate a force transmitted to said shaft to deform said shaft and thereby deform a leading edge of a sheet;

said force generated by said deflection device is substantially in a direction substantially perpendicular to each of: the axis of said shaft and the axis of said gripper bridge;

the direction of said force generated by said deflection device defines a line of action of said force; and the line of action of said force extends through said center portion of said shaft; and F) said deflection device is disposed to generate a plurality of forces transmitted to said shaft to deform said shaft and thereby deform a leading edge of a sheet;

each one of said plurality of forces is substantially in a direction substantially perpendicular to each of: the axis of said shaft and the axis of said gripper bridge;

the direction of each one of said plurality of forces defines a corresponding line of action of said each one of said plurality of forces;

said corresponding line of action of said each one of said plurality of forces extends through said shaft;

said plurality of forces comprises a first force and a second force; and the corresponding line of action of said first force is separated from the corresponding line of action of said second force by a substantial distance measured along the axis of said shaft.

6. The feed cylinder according to claim 5, wherein:

at least one of said first and second end portions of said gripper bridge comprises a corresponding set of characteristics A) and C);

said corresponding set of characteristics A) and C) further comprises one of the following sets of characteristics G), H) and I):

G) said body of said feed cylinder comprises an abutment;

said pivoting portion of said at least one of said first and second end portions is configured to cooperatively engage said abutment; and H) said first and second fastening arrangement corresponding to said at least one of said first and second portions comprises a spacer; and said spacer is disposed between said pivoting portion of said at least one of said first and second end portions and said body of said feed cylinder; and I) said first and second fastening arrangement corresponding to said at least one of said first and second portions comprises a first washer and a second washer;

each one of said first and second washers comprises a substantially spherical surface; and said substantially spherical surface of said first washer is disposed to cooperatively engage said substantially spherical surface of said second washer to permit pivoting of said pivoting portion.

7. A device for registration correction by deforming the leading edge of a sheet for a sheet-fed rotary printing press, said device comprising:

a shaft having a longitudinal axis;

a gripping device to grip a sheet for transport along a sheet path;

said gripping device being disposed along said shaft;

a mounting apparatus to mount said shaft to a cylinder of a sheet-fed rotary printing press;

a deflection device to generate a force to deform said shaft and thereby deform a leading edge of a sheet;

said deflection device being operatively connected to said shaft to deform said shaft upon a force being generated by said deflection device;

said mounting apparatus being configured to be attached to a cylinder of a sheet-fed rotary printing press;

said shaft comprising a first end portion and an axially opposite second end portion;

each of said first and second end portions of said shaft being rotatably mounted on said mounting apparatus;

said shaft being configured to be bendable along the axis of said shaft during receipt of a force from said deflection device to deform said shaft and thereby deform a leading edge of a sheet;

said mounting apparatus comprising a pivoting arrangement;

said pivoting arrangement being configured to permit pivoting of each of said first and second end portions of said shaft during bending of said shaft; and said pivoting arrangement being disposed to permit pivoting of each of said first and second end portions of said shaft during bending of said shaft upon receipt of a force from said deflection device.

8. The device for registration correction according to claim 7, wherein:

said mounting apparatus comprises a beam;

said beam has a longitudinal axis;

the longitudinal axis of said beam is disposed substantially parallel with the axis of said shaft;

said beam comprises a first end portion and an axially opposite second end portion;

said first end portion of said shaft is mounted on said first end portion of said beam; and said second end portion of said shaft is mounted on said second end portion of said beam.

9. The device for registration correction according to claim 8, wherein:

said beam is configured to transfer a force between said deflection device and a cylinder of a sheet-fed rotary printing press; and said pivoting arrangement of said mounting apparatus comprises each of said first and second end portions of said beam being disposed to permit pivoting of said first and second end portions of said beam upon the transfer of a force between said deflection apparatus and a cylinder of a sheet-fed rotary printing press.

10. The device for registration correction according to claim 9, wherein:

said beam comprises an intermediate portion;

said intermediate portion of said beam is disposed between said first and second end portions of said beam;

said intermediate portion of said beam comprises a cross-section area disposed substantially perpendicular to the axis of said beam;

said mounting apparatus comprises a first fastening arrangement and a second fastening arrangement;

said first fastening arrangement is configured to fasten said first end portion of said beam to a cylinder of a sheet-fed rotary printing press;

said second fastening arrangement is configured to fasten said second end portion of said beam to a cylinder of a sheet-fed rotary printing press;

each of said first and second end portions of said beam are configured to be attached to a cylinder of a sheet-fed rotary printing press;

said first end portion of said beam being disposed to permit pivoting comprises one of the following sets of characteristics A) and B):

A) said first end portion of said beam comprises a pivoting portion; and said pivoting portion of said first end portion of said beam is configured to pivot about a first pivoting axis;

B) one of: said first end portion of said beam and said first fastening arrangement comprises a first portion;

said first portion of said one of said first end portion of said beam and said first fastening arrangement comprises a cross-section area disposed substantially perpendicular to the axis of said beam; and said cross-section area of said first portion is substantially less than the cross-section area of said intermediate portion of said beam; and said second end portion of said beam being disposed to permit pivoting comprises one of the following sets of characteristics C) and D):

C) said second end portion of said beam comprises a pivoting portion; and said pivoting portion of said second end portion of said beam is configured to pivot about a second pivoting axis;

D) one of: said second end portion of said beam and said second fastening arrangement comprises a second portion;

said second portion of said one of said second end portion of said beam and said second fastening arrangement comprises a cross-section area disposed substantially perpendicular to the axis of said beam; and said cross-section area of said second portion is substantially less than the cross-section area of said intermediate portion of said beam.

11. The device for registration correction according to claim 10, wherein:

said shaft comprises a center portion;

said center portion of said shaft is disposed substantially equidistant between said first and second end portions of said shaft;

said deflection device comprises one of the following E) and F):

E) said deflection device is disposed to generate a force transmitted to said shaft to deform said shaft and thereby deform a leading edge of a sheet;

said force generated by said deflection device is substantially in a direction substantially perpendicular to each of: the axis of said shaft and the axis of said beam;

the direction of said force generated by said deflection device defines a line of action of said force; and the line of action of said force extends through said center portion of said shaft; and F) said deflection device is disposed to generate a plurality of forces transmitted to said shaft to deform said shaft and thereby deform a leading edge of a sheet;

each one of said plurality of forces is substantially in a direction substantially perpendicular to each of: the axis of said shaft and the axis of said beam;

the direction of each one of said plurality of forces defines a corresponding line of action of said each one of said plurality of forces;

said corresponding line of action of said each one of said plurality of forces extends through said shaft;

said plurality of forces comprises a first force and a second force; and the corresponding line of action of said first force is separated from the corresponding line of action of said second force by a substantial distance measured along the axis of said shaft.

12. The device for registration correction according to claim 11, wherein:

said mounting apparatus comprises a first bearing;

said first end portion of said shaft is mounted within said first bearing to rotatably mount said first end portion of said shaft;

said first bearing is attached to said first end portion of said beam;

said mounting apparatus comprises a second bearing;

said second end portion of said shaft is mounted within said second bearing to rotatably mount said second end portion of said shaft;

said second bearing is attached to said second end portion of said beam;

said mounting apparatus comprises at least one third bearing;

said at least one third bearing is disposed between said first and second bearings;

said shaft rotatably extends through said at least one third bearing to at least partially support said shaft; and said at least one third bearing is attached to said beam between said first and second bearings.

13. The device for registration correction according to claim 12, wherein:

at least one of said first and second end portions of said beam comprises a corresponding set of characteristics A) and C);

said corresponding set of characteristics A) and C) further comprises one of the following sets of characteristics G), H) and I);

G) said pivoting portion of said at least one of said first and second end portions is configured to cooperatively engage a corresponding abutment disposed on a cylinder of a sheet-fed rotary printing press; and H) said first and second fastening arrangement corresponding to said at least one of said first and second portions comprises a spacer; and said spacer is configured to be disposed between said pivoting portion of said at least one of said first and second end portions and a cylinder of a sheet-fed rotary printing press to permit pivoting of said pivoting portion; and I) said first and second fastening arrangement corresponding to said at least one of said first and second portions comprises a first washer and a second washer;

each one of said first and second washers comprises a substantially spherical surface; and said substantially spherical surface of said first washer is disposed to cooperatively engage said substantially spherical surface of said second washer to permit pivoting of said pivoting portion.

14. A device for registration correction by deforming the leading edge of a sheet for a sheet-fed rotary printing press, said device comprising:

a shaft having a longitudinal axis;

a gripping apparatus to grip a sheet for transport along a sheet path;

said gripping apparatus being disposed along said shaft;

a mounting apparatus to mount said shaft to a cylinder of a sheet-fed rotary printing press;

said mounting apparatus being configured to be attached to a cylinder of a sheet-fed rotary printing press;

said shaft comprising a first end portion and an axially opposite second end portion;

each of said first and second end portions of said shaft being rotatably mounted on said mounting apparatus;

said shaft being configured to receive a force from a deflection apparatus to deform said shaft and thereby deform a leading edge of a sheet;

said shaft being configured to be bendable along the axis of said shaft during receipt of a force from a deflection apparatus to deform said shaft and thereby deform a leading edge of a sheet;

said mounting apparatus comprising a pivoting arrangement;

said pivoting arrangement being configured to permit pivoting of each of said first and second end portions of said shaft during bending of said shaft; and said pivoting arrangement being disposed to permit pivoting of each of said first and second end portions of said shaft during bending of said shaft upon receipt of a force from a deflection apparatus.

15. The registration correction device according to claim 14, wherein:

said mounting apparatus comprises a beam;

said beam has a longitudinal axis;

said beam is disposed substantially parallel with the axis of said shaft;

said beam comprises a first end portion and an axially opposite second end portion;

said first end portion of said shaft is mounted on said first end portion of said beam; and said second end portion of said shaft is mounted on said second end portion of said beam.

16. The registration correction device according to claim 15, wherein:

said beam is configured to transfer a force between a deflection apparatus and a cylinder of a sheet-fed rotary printing press; and said pivoting arrangement of said mounting apparatus comprises each of said first and second end portions of said beam being disposed to permit pivoting of said first and second end portions of said beam upon the transfer of a force between said deflection apparatus and a cylinder of a sheet-fed rotary printing press.

17. The registration correction device according to claim 16, wherein:

said beam comprises an intermediate portion;

said intermediate portion of said beam is disposed between said first and second end portions of said beam;

said intermediate portion of said beam comprises a cross section area disposed substantially perpendicular to the axis of said beam;

said mounting apparatus comprises a first fastening arrangement and a second fastening arrangement;

said first fastening arrangement is configured to fasten said first end portion of said beam to a cylinder of a sheet-fed rotary printing press;

said second fastening arrangement is configured to fasten said second end portion of said beam to a cylinder of a sheet-fed rotary printing press;

each of said first and second end portions of said beam are configured to be attached to a cylinder of a sheet-fed rotary printing press;

said first end portion of said beam being disposed to permit pivoting comprises one of the following sets of characteristics A) and B):

A) said first end portion of said beam comprises a pivoting portion; and said pivoting portion of said first end portion of said beam is configured to pivot about a first pivoting axis;

B) one of: said first end portion of said beam and said first fastening arrangement comprises a first portion;

said first portion of said one of said first end portion of said beam and said first fastening arrangement comprises a cross-section area disposed substantially perpendicular to the axis of said beam; and said cross-section area of said first portion is substantially less than the cross-section area of said intermediate portion of said beam; and said second end portion of said beam being disposed to permit pivoting comprises one of the following sets of characteristics C) and D):

C) said second end portion of said beam comprises a pivoting portion; and said pivoting portion of said second end portion of said beam is configured to pivot about a second pivoting axis; and D) one of: said second end portion of said beam and said second fastening arrangement comprises a second portion;

said second portion of said one of said second end portion of said beam and said second fastening arrangement comprises a cross-section area disposed substantially perpendicular to the axis of said beam; and said cross-section area of said second portion is substantially less than the cross-section area of said intermediate portion of said beam.

18. The registration correction device according to claim 17, wherein:

said mounting apparatus comprises a first bearing;

said first end portion of said shaft is mounted within said first bearing to rotatably mount said first end portion of said shaft;

said first bearing is attached to said first end portion of said beam;

said mounting apparatus comprises a second bearing;

said second end portion of said shaft is mounted within said second bearing to rotatably mount said second end portion of said shaft;

said second bearing is attached to said second end portion of said beam;

said mounting apparatus comprises at least one third bearing;

said at least one third bearing is disposed between said first and second bearings;

said shaft rotatably extends through said at least one third bearing to at least partially support said shaft; and said at least one third bearing is attached to said beam between said first and second bearings.

19. The registration correction device according to claim 18, wherein:

said shaft comprises a center portion;

said center portion of said shaft is disposed substantially equidistant from said first and second end portions of said shaft;

said registration correction device comprises a deflection apparatus to deform said shaft and thereby deform a leading edge of a sheet;

said deflection apparatus comprises one of the following E) and F):

E) said deflection apparatus is disposed to generate a force transmitted to said shaft to deform said shaft and thereby deform a leading edge of a sheet;

said force generated by said deflection apparatus is substantially in a direction substantially perpendicular to each of: the axis of said shaft and the axis of said beam;

the direction of said force generated by said deflection apparatus defines a line of action of said force; and the line of action of said force extends through said center portion of said shaft; and F) said deflection apparatus is disposed to generate a plurality of forces transmitted to said shaft to deform said shaft and thereby deform a leading edge of a sheet;

each one of said plurality of forces is substantially in a direction substantially perpendicular to each of: the axis of said shaft and the axis of said beam;

the direction of each one of said plurality of forces defines a corresponding line of action of said each one of said plurality of forces;

said corresponding line of action of said each one of said plurality of forces extends through said shaft;

said plurality of forces comprises a first force and a second force; and the corresponding line of action of said first force is separated from the corresponding line of action of said second force by a substantial distance measured along the axis of said shaft.

20. The registration correction device according to claim 19, wherein:

at least one of said first and second end portions of said beam comprises a corresponding set of characteristics A) and C);

said corresponding set of characteristics A) and C) further comprises one of the following sets of characteristics G), H) and I):

G) said pivoting portion of said at least one of said first and second end portions is configured to cooperatively engage a corresponding abutment disposed on a cylinder of a sheet-fed rotary printing press; and H) said first and second fastening arrangement corresponding to said at least one of said first and second portions comprises a spacer; and said spacer is configured to be disposed between said pivoting portion of said at least one of said first and second end portions and a cylinder of a sheet-fed rotary printing press to permit pivoting of said pivoting portion; and I) said first and second fastening arrangement corresponding to said at least one of said first and second portions comprises a first washer and a second washer;

each one of said first and second washers comprises a substantially spherical surface; and said substantially spherical surface of said first washer is disposed to cooperatively engage said substantially spherical surface of said second washer to permit pivoting of said pivoting portion.

* * * * *

UNITED STATES PATENT AND TRADEMARK OFFICE

CERTIFICATE OF CORRECTION

PATENT NO. : 5,749,296

DATED : May 12, 1998

INVENTOR(S) : Rudi HAUPENTHAL

It is certified that error appears in the above-identified patent and that said Letters Patent is hereby corrected as shown below:

In column 7, line 6, after 'curve', delete " "" " and insert --"b"--.

Signed and Sealed this

Twenty-second Day of September, 1998

*Attest:*

*Attesting Officer*

Bruce Lehman

BRUCE LEHMAN

*Commissioner of Patents and Trademarks*